United States Patent [19]

Negishi et al.

[11] Patent Number: 4,632,257

[45] Date of Patent: Dec. 30, 1986

[54] ARTICLE DISPENSING MECHANISM FOR A VENDING MACHINE

[75] Inventors: Hideo Negishi; Mitsuyuki Obokata; Shigeharu Katayama, all of Isesaki, Japan

[73] Assignee: Sanden Corporation, Gunma, Japan

[21] Appl. No.: 689,319

[22] Filed: Jan. 7, 1985

[51] Int. Cl.[4] ..... A47F 5/00

[52] U.S. Cl. ..... 211/59.2; 193/2 R; 211/189; 248/222.3

[58] Field of Search ..... 211/59.2, 189, 135; 312/42, 45; 248/222.3, 558; 221/241; 193/2 R, 27

[56] References Cited

U.S. PATENT DOCUMENTS

| | | | |
|---|---|---|---|
| 1,491,091 | 4/1924 | Flynn | 211/135 |
| 1,814,449 | 7/1931 | Morgenstern | 248/DIG. 6 X |
| 1,981,272 | 11/1934 | Kuhn et al. | 193/27 X |
| 2,307,992 | 1/1943 | Calhoun et al. | 211/135 X |
| 3,193,135 | 7/1965 | Bentzman . | |
| 3,276,624 | 10/1966 | Payne . | |
| 3,498,497 | 3/1970 | Baxendale et al. . | |
| 3,613,945 | 10/1971 | Rockola . | |
| 3,710,919 | 1/1973 | Maters | 193/27 X |
| 4,447,030 | 5/1984 | Nattel | 248/DIG. 6 X |
| 4,456,147 | 6/1984 | Tominaga | 211/59.2 X |

*Primary Examiner*—Robert W. Gibson, Jr.

*Attorney, Agent, or Firm*—Banner, Birch, McKie & Beckett

[57] ABSTRACT

An article dispensing mechanism for a vending machine includes at least one serpentine track comprised of a pair of facing cusp-shaped vertical panels. These panels are supported on a pair of facing side plates. Each panel has a plurality of projections which extend horizontally from opposite side surfaces of the panel and extend into rectangular-shaped holes formed in both side plates. Each vertical panel is securely fixed on both plates by twisting the outer terminal portion of the projections which extend outwardly from the rectangular-shaped holes.

11 Claims, 7 Drawing Figures

ARTICLE DISPENSING MECHANISM FOR A VENDING MACHINE

TECHNICAL FIELD

This invention relates to an article dispensing mechanism for a vending machine, and more particularly, to a serpentine type article dispensing mechanism for dispensing cylindrical articles.

BACKGROUND OF THE INVENTION

It is generally known in the art that the use of single or double depth serpentine track dispensing mechanisms for cylindrical articles increases storage capacity without increasing the size of the outer configuration of the article storage area. As shown in U.S. Pat. Nos. 3,498,497 and 3,613,945, each serpentine track has a meandering shape from top to bottom which causes cylindrical articles to roll down by the force of gravity from its upper end to a discharge opening at its lower end. Delivery of these cylindrical articles from the discharge opening is controlled by a discharge control device disposed at the discharge opening.

In serpentine track type dispensing mechanisms of the above type, the serpentine track is generally formed by a plurality of serial cusp-shaped vertical panels. FIGS. 1 and 2 illustrate a prior art configuration of a serpentine track dispensing mechanism.

Serpentine track type dispensing mechanism 10 comprises a plurality of cusp-shaped vertical panels 13 each of which is supported transversely between side plates 15*a* and 15*b* and has a semicircular cusp-shaped portion 13*a*. Therefore, serpentine track 12 is formed by a pair of the facing vertical panels 13 with the semicircular cusp-shaped portions 13*a* alternating with one another, i.e., connecting portion 14 which is formed on each vertical end portion of panel 13 is not aligned with the corresponding portion 14 on the opposed panel 13. As shown in FIG. 1, each connecting portion 14 has a curl portion 14*a* through which a supporting member 16 horizontally extends. Both end portions of supporting member 16 are positioned in a hole 17 formed in each side plate 15*a*, 15*b*. A nut 18 is screwed onto each outer end portion of supporting member 16 which extends from holes 17. Each panel 13 is thus securely fixed between the faces of side plates 15*a*, 15*b*. The assembly process of the dispensing mechanism requires plural supporting members to be inserted into the curl portions of the panels through side plates and for the nuts to be screwed on both end portions of the supporting members. The assembly process of this type dispensing mechanism is therefore complicated so that manufacturing productivity is reduced.

SUMMARY OF THE INVENTION

It is a primary object of this invention to provide an improved article dispensing mechanism for vending machines that utilizes a serpentine track wherein manufacturing productivity can be improved.

It is another object of this invention to provide an article dispensing mechanism for vending machines which is simple in construction and easy to assemble.

It is still another object of this invention to accomplish the above objects while reducing the cost of dispensing mechanism.

An article dispensing mechanism for vending machines according to this invention includes a pair of side plates which face each other to define a predetermined gap therebetween forming a storage area for articles. Plural pairs of cusp-shaped vertical panels are supported between two side plates to form one or more serpentine tracks, each of which includes an upper end opening for loading and a lower end opening for connecting with a discharge space. Each vertical panel is supported between the two side plates of the dispenser storage area by a plurality of projections which extend from opposite side surfaces of the vertical panel. Each projection extends into a rectangular-shaped hole formed in the side plates. An outer end portion of each projection projects outward from the side plate, and is twisted to secure the panel to the side plate.

Further objects, features and other aspects of this invention will be understood from the following detailed description of a preferred embodiment of this invention referring to annexed drawings.

DETAILED DESCRIPTION OF THE PREFERRED EMBODIMENT

Figure 3:
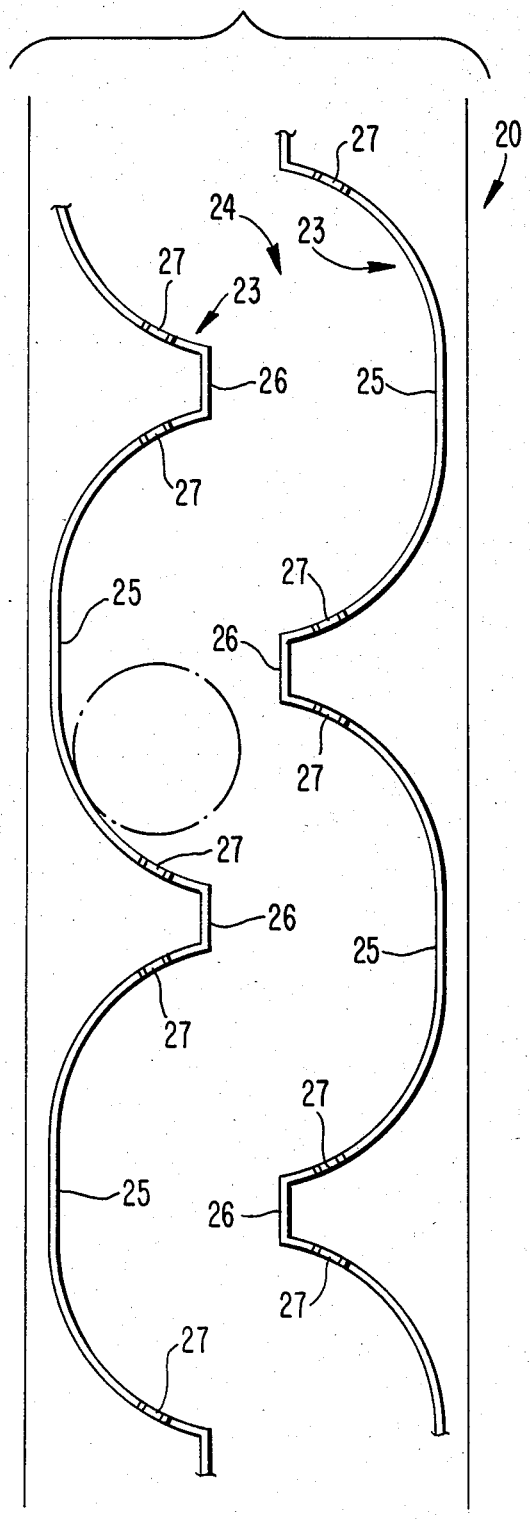
FIG. 3 is a schematic side view of a dispensing mechanism according to the invention wherein the side plates are removed to illustrate only the serpentine panels.
Figure 4:
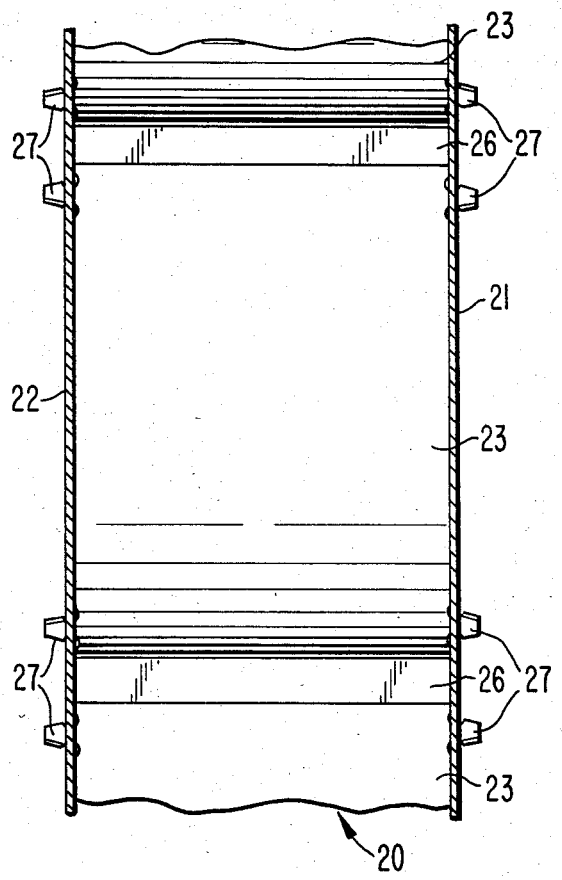
FIG. 4 is a front view of the dispensing mechanism shown in FIG. 3.

Referring to FIGS. 3 and 4, a serpentine track type dispensing mechanism 20 includes a pair of side plates 21 and 22 and a pair of serial cusp-shaped vertical panels 23 which face one another in a spaced-staggered relationship to define a serpentine track 24. Side plates 21 and 22 are suitably connected together to be parallel to each other and to define between them a predetermined gap forming a space for article loading and discharging. The gap will of course be adequate to accommodate the length of the cylindrical articles which are to be stored in and dispensed from the dispensing mechanism storage area.

Serial cusp-shaped vertical panels 23 are supported transversely between side plates 21 and 22. As best shown in FIG. 3, each vertical panel 23 has a plurality of semicircular cusp-shaped portions 25 connected in series by transit portions 26. Serpentine track 24 is formed by a facing pair of panels 23 with the semi-circular shaped portions 25 alternating with one another, i.e., transit portions 26 interconnecting semicircular shaped portions 25 on one panel 23 are not aligned with the corresponding portion 26 on the opposed panel 23. The width of space defining each track 24 as measured in any horizontal plane along the length of the track is preferably slightly greater than the diameter of the maximum size article it is contemplated the dispensing mechanism will be called upon to handle. Of course, it is intended that the mechanism will handle several different diameter articles.

Thus, the upper opening of serpentine track 24 defined by a pair of vertical panels 23 is connected with a loading space (not shown) to load and then store the dispensing articles therein. The lower opening of serpentine track 24 is connected with a discharge space (not shown) to deliver the stored articles one by one through the operation of a dispensing device. Detailed construction and operation of the overall serpentine track-type dispensing mechanism within which this invention would be used is described in the above mentioned prior U.S. patents, incorporated herein by reference.

Figure 5:
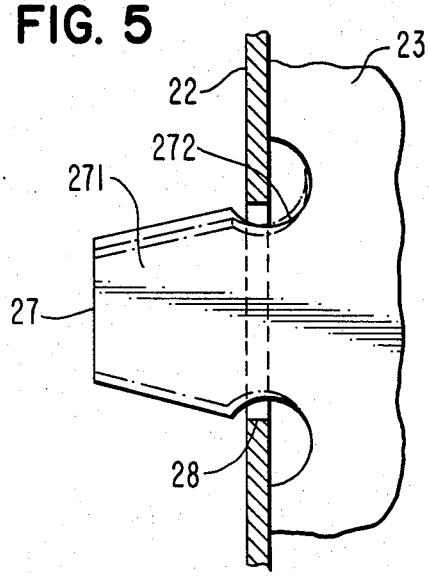
FIG. 5 is an enlarged partial vertical sectional view of the dispensing mechanism illustrating details of the attachment between a side plate and a vertical panel.
Figure 6:
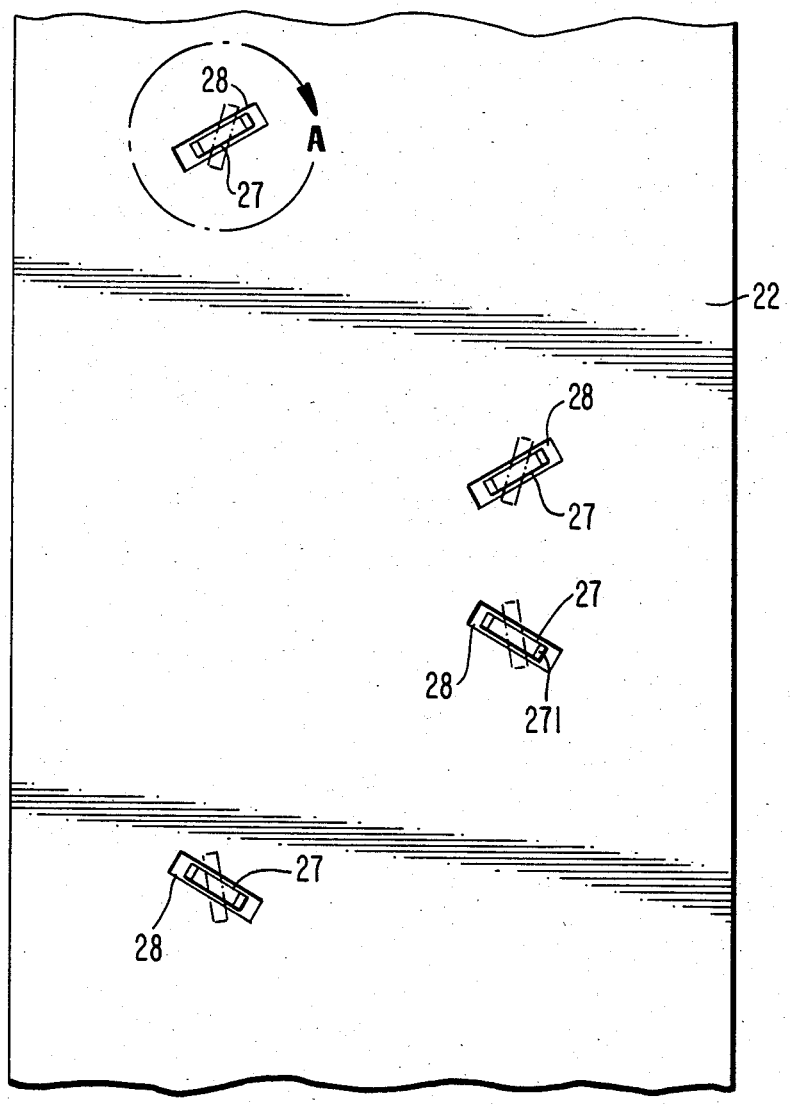
FIG. 6 is a side view of the dispensing mechanism.
Figure 6A:
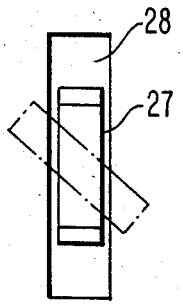
FIG. 6A is an enlarged view of portion A of FIG. 6.

As best shown in FIGS. 4, 5, 6 and 6A, each vertical panel 23 is supported between side plates 21 and 22 by a plurality of projections 27. Projection 27 extends horizontally from both side surfaces of vertical panel 23 and into elongate, preferably rectangular-shaped holes 28 which are formed in each side plate 21 and 22. As shown in FIG. 5, in this embodiment, projection 27 is formed of a trapezoid-shaped portion 271, and a base portion 272. Base portion 272 of projection 27, which is interconnected to side surface of panel 23 is cut away in a semicircular curve forming a narrow width at the base of projection 27. After assembling vertical panels 23 between side plates 21 and 22, the outer ends of each projection 27, which extend through the rectangular-shaped holes 28, are twisted to securely fix panels 23 on each side plate 21 and 22. Because, during the twisting of projection 27, base portion 272 twists together with trapezoid-shaped portion 271, it contacts tightly against the inner surface of a rectangular hole 28. Further twisting of trapezoid-shaped portion 271 causes an outer edge of base portion 272 to contact the outer surface of the side plate. The narrow base of projection 27 thus interconnects with the side panel. Projections 27 are shown in their twisted positions in dash line in FIGS. 6 and 6A. Panels 23 and projections 27 can be made of steel.

In summary, a pair of opposed serial cusp-shaped vertical panels are supported by side plates to form a serpentine track. Each vertical panel has a plurality of trapezoid-shaped projections extending from its side surfaces. Each side plate also has a plurality of rectangular-shaped holes though which the projections extend. In the assembly of the dispensing mechanism the outer portion of each projection which extends outward from the rectangular-shaped hole is twisted by some angle to securely fix the panels on the side plates. Therefore, the assembly process of the dispensing mechanism can be improved and simplified to increase manufacturing productivity.

Figure 1:
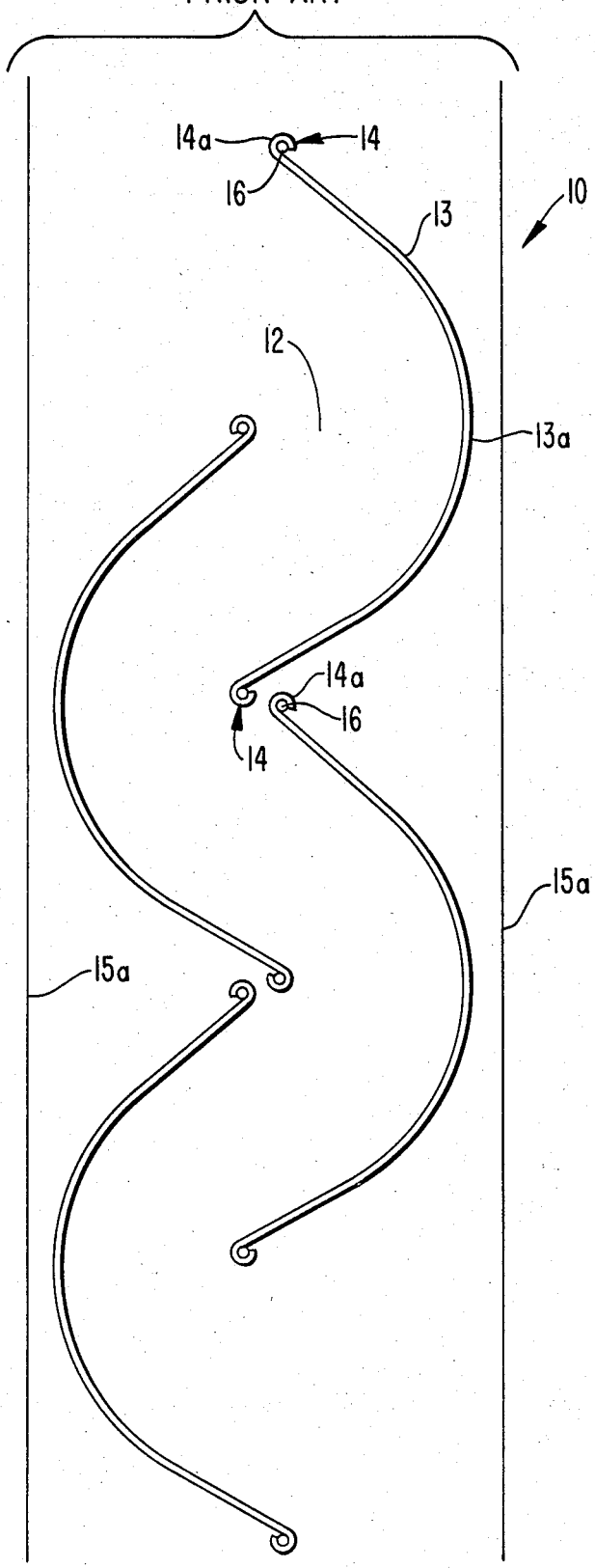
FIG. 1 PRIOR ART
FIG. 1 is a schematic side view of a prior art dispensing mechanism wherein the side plates are removed to illustrate only the serpentine panels.
Figure 2:
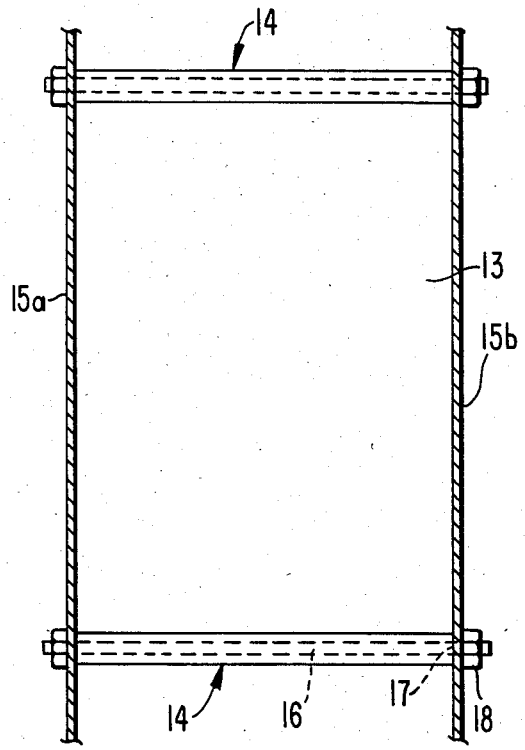
FIG. 2 PRIOR ART
FIG. 2 is a front view of the dispensing mechanism shown in FIG. 1.

As illustrated and described in this embodiment, the vertical panels 23 each consist of one unitary element. Alternatively, the serpentine track may be formed by a plurality of individual cusp-shaped portions, such as shown in FIG. 1, but including connecting projection 27.

An example of a preferred embodiment of this invention has been described in detail, but the invention is not to be considered as restricted thereto. It will be easily understood by those skilled in the art that many other variations and modifications can be made all within the scope of this invention as claimed.

What is claimed is:

1. In an article dispensing mechanism for a vending machine including a pair of side plates facing one another at a predetermined spacing and at least one pair of serial cusp-shaped vertical panels disposed transversely between said side plates, said panels facing each other to define a serpentine track, the improvement comprising said vertical panels having a plurality of projections horizontally extending from each side surface, each side plate having a plurality of elongate holes located so that an outer portion of said projections penetrates and extends through said holes, said projections having an outer edge, and said outer portions of said projections are twisted to place said outer edge of said projections in contact with said side plates and fix said vertical panels to said side plates.

2. The article dispensing mechanism for a vending machine of claim 1 wherein each projection has a narrow width base which interconnects with said panel.

3. The article dispensing mechanism for a vending machine of claim 2 wherein said narrow width base of said projection is formed in a curved configuration.

4. The article dispensing mechanism for a vending machine of claim 1 wherein each projection comprises a trapezoidal-shaped portion and a semicircular shaped base portion.

5. The article dispensing mechanism for a vending machine of claim 1 wherein each vertical panel comprises a plurality of separate cusp-shaped elements.

6. The article dispensing mechanism for a vending machine of claim 1 wherein each vertical panel comprises a plurality of cusp-shaped elements which are integrally formed with one another.

7. The article dispensing mechanism for a vending machine of claim 1 wherein said elongate holes are rectangular.

8. The article dispensing mechanism for a vending machine of claim 2 wherein said outer edge of said projections in the area of said narrow width base contacts an inner surface of said side plates in the twisted position of said projections.

9. The article dispensing mechanism for a vending machine of claim 2 wherein said outer edge of said projections in the area of said narrow width base contacts both an inner and an outer surface of said side plates in the twisted position of said projections.

10. The article dispensing mechanism for a vending machine of claim 3 wherein said outer edge of said projections in the area of said narrow width base contacts an inner surface of said side plates in the twisted position of said projections.

11. The article dispensing mechanism for a vending machine of claim 3 wherein said outer edge of said projections in the area of said narrow width base contacts both an inner and an outer surface of said side plates in the twisted position of said projections.

* * * * *